US007865113B2

(12) United States Patent
Nakashima

(10) Patent No.: US 7,865,113 B2
(45) Date of Patent: Jan. 4, 2011

(54) IMAGE FORMING APPARATUS WITH A REMOVABLE TRANSFERRING UNIT

(75) Inventor: Atsuhisa Nakashima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 533 days.

(21) Appl. No.: 11/947,108

(22) Filed: Nov. 29, 2007

(65) Prior Publication Data

US 2008/0138112 A1 Jun. 12, 2008

(30) Foreign Application Priority Data

Dec. 6, 2006 (JP) ..... 2006-329428

(51) Int. Cl.
*G03G 15/08* (2006.01)

(52) U.S. Cl. ..... 399/121

(58) Field of Classification Search ..... 399/110, 399/121, 299, 302, 308, 312
See application file for complete search history.

(56) References Cited

U.S. PATENT DOCUMENTS

| | | | | |
|---|---|---|---|---|
| 5,669,054 | A * | 9/1997 | Uchida et al. | 399/313 |
| 6,522,848 | B2 | 2/2003 | Wakana | |
| 7,257,351 | B2 * | 8/2007 | Tachiki et al. | 399/121 |
| 7,424,947 | B2 * | 9/2008 | Nakano | 198/814 |
| 7,454,158 | B2 * | 11/2008 | Nakano et al. | 399/121 |
| 7,526,227 | B2 * | 4/2009 | Sato et al. | 399/110 |
| 7,577,380 | B2 * | 8/2009 | Mori | 399/121 |
| 7,623,809 | B2 * | 11/2009 | Nakano et al. | 399/121 |
| 2006/0045570 | A1 | 3/2006 | Kato et al. | |
| 2007/0025762 | A1 * | 2/2007 | Kato et al. | 399/121 |
| 2007/0048010 | A1 * | 3/2007 | Nakano | 399/121 |

FOREIGN PATENT DOCUMENTS

| | | |
|---|---|---|
| JP | 2000-275987 | 10/2000 |
| JP | 2002-060039 | 2/2002 |
| JP | 2004-144918 | 5/2004 |
| JP | 2006-072008 | 3/2006 |

* cited by examiner

*Primary Examiner*—Robert Beatty
(74) *Attorney, Agent, or Firm*—Banner & Witcoff, Ltd.

(57) ABSTRACT

An image forming apparatus is described. The image forming apparatus may include a casing, developing agent carriers, an image carrier, and a transferring unit anteroposteriorly detachably mountable to the casing on a front side of the casing. The transferring unit includes a projection at a rear end portion thereof and the casing includes a restricting portion that is arranged lower than the projection of the transferring unit midway through mounting and is engaged with the projection at completion of the mounting of the transferring unit. At least one of the casing and the transferring unit includes a first guide portion for guiding the transferring unit by inclining the transferring unit so that the rear end portion of the transferring unit midway through the mounting is more downwardly inclined than the rear end portion at the completion of the mounting of the transferring unit.

20 Claims, 9 Drawing Sheets

IMAGE FORMING APPARATUS WITH A REMOVABLE TRANSFERRING UNIT

CROSS REFERENCE TO RELATED APPLICATION

This application claims priority to Japanese Patent Application No. 2006-329428 filed on Dec. 6, 2006, the disclosure of which is hereby incorporated into the present application by reference.

TECHNICAL FIELD

The present invention relates to an image forming apparatus, such as a laser printer.

BACKGROUND

An image forming apparatus, in which a transferring unit for transferring a toner image on a sheet is detachably mounted, has been conventionally known.

As such an image forming apparatus, there has been proposed an electrophotographic printing apparatus in which a transfer belt unit, including a loop-shaped transfer belt, a drive roller and an idle roller both wound around by the transfer belt, and a belt frame retaining shafts of these rollers, is detachably mounted.

In this electrophotographic printing apparatus, the transfer belt unit is attached or detached on the upper side of the electrophotographic printing apparatus.

In the transfer belt unit, a lock portion is provided on the belt frame, and a bearing is attached to each of both ends of the drive roller and the idle roller. On the other hand, the electrophotographic printing apparatus is provided with a lock mechanism and a bearing-receiving portion. When the transfer belt unit is mounted in the electrophotographic printing apparatus, the lock portion fits in the lock mechanism and the bearing fits in the bearing-receiving portion, and the transfer belt unit is thus positioned in an inner portion of the electrophotographic printing apparatus.

In recent years, an image forming apparatus allowing for replacement of spare parts, such as a transfer belt unit, on the user standing position side (near side), a so-called front accessible image forming apparatus, has been desired. However, the electrophotographic printing apparatus is not adopted for such front access because the transfer belt unit is attached and detached on the upper side.

SUMMARY

One aspect of the present invention may provide an image forming apparatus allowing smooth mounting and positioning of a transferring unit by front access.

The same or different aspect of the present invention may provide an image forming apparatus including: a casing; a plurality of developing agent carriers provided in the casing and carrying developing agents of mutually different colors; an image carrier provided in the casing, supplied with a developing agent from each of the developing agent carriers, and carrying a developing agent image thereon; and a transferring unit anteroposteriorly detachably mountable to the casing on a front side of the casing, for transferring the developing agent image carried on the image carrier to a transfer medium, wherein the transferring unit includes a projection at a rear end portion thereof, the casing includes a restricting portion that is arranged lower than the projection of the transferring unit midway through mounting and is engaged with the projection at completion of the mounting of the transferring unit, thereby restricting an upward movement of the projection, and at least one of the casing and the transferring unit includes a first guide portion for guiding the transferring unit by inclining the transferring unit so that the rear end portion of the transferring unit midway through the mounting is more downwardly inclined than the rear end portion at the completion of the mounting of the transferring unit, thereby engaging the projection with the restricting portion.

DETAILED DESCRIPTION

Figure 1:
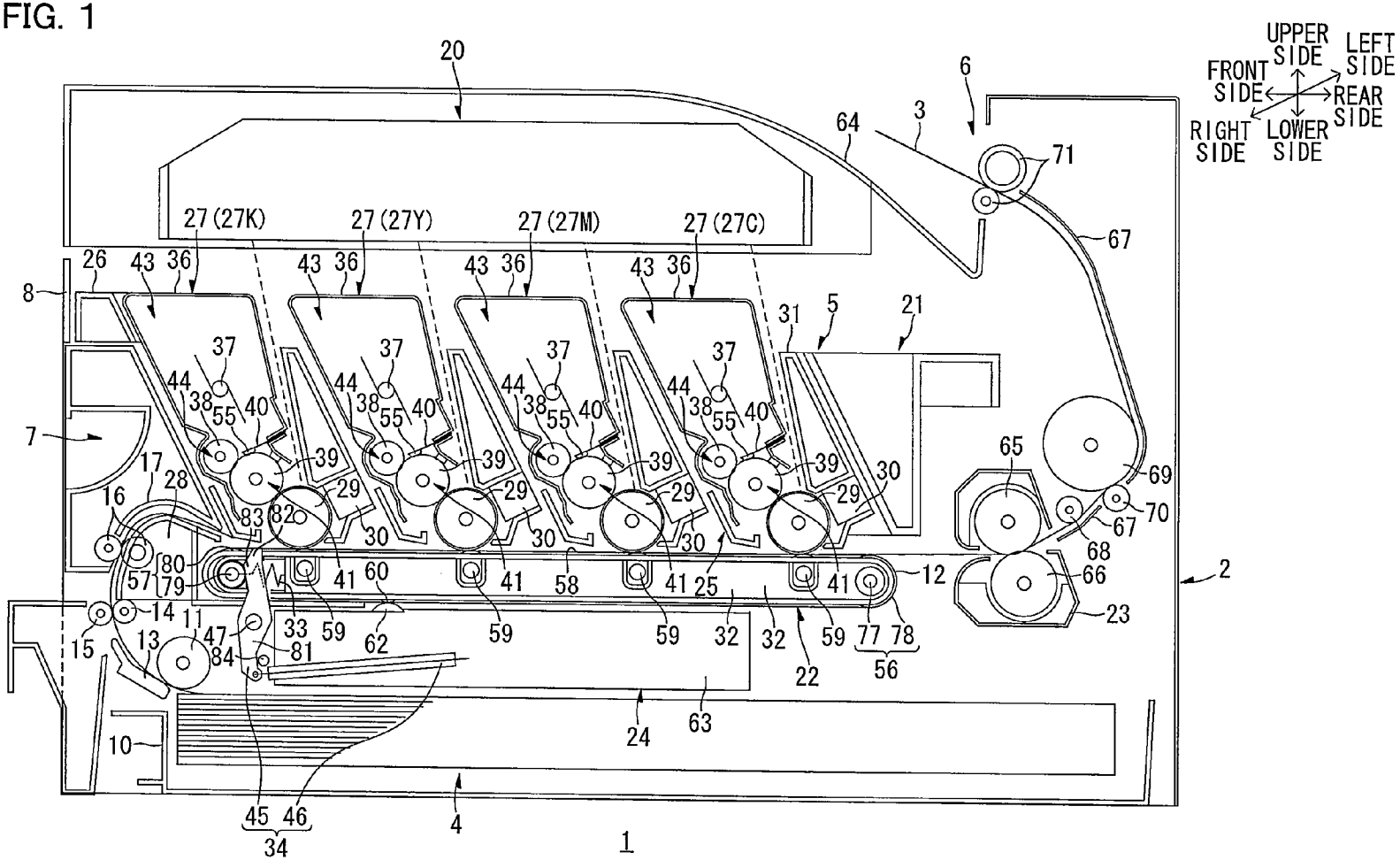
FIG. 1 is a side sectional view of a color laser printer as an example of an image forming apparatus of one or more aspects of the present invention.

The embodiments of one or more aspects of the present invention will be described below while referring to the drawings.

First Embodiment

1. General Structure of Color Laser Printer

FIG. 1 is a side sectional view of a color laser printer as an example of an image forming apparatus of one or more aspects of the present invention.

The color laser printer 1 is of a horizontal-tandem type, in which a plurality of photosensitive drums 29 described later as an example of an image carrier are horizontally arranged in juxtaposition.

The color laser printer 1 includes a sheet feeding section 4 for feeding a sheet 3 as an example of a transferring medium, an image forming section 5 for forming an image on the fed sheet 3 and a sheet ejecting section 6 for ejecting the sheet 3 formed with the image, in the main body casing 2 as an example of a casing.

(1) Main Body Casing

The main body casing 2 is formed in a box-like shape of a generally rectangular shape in side view, and detachably includes a processing unit 21 as an example of a retaining unit described later and a transferring unit 22 in the inner portion thereof.

In the following description, the left side of FIG. 1 is referred to as the front side (front view side), while the right side of FIG. 1 is referred to as the rear side (rear view side). An anteroposterior direction is the same as a horizontal direction. The front side of the main body casing 2 is a user standing position side, and on the front side of the main body casing 2, a front cover 8 described later is opened/closed, and an operation panel (not shown) operated by a user is also arranged. A left and right direction is determined when the color laser printer 1 is viewed from the front side. The left and right direction is the same as a width direction. Further, the processing unit 21 and the transferring unit 22 will be explained based on the directions while they are mounted in the main body casing 2, unless otherwise noted.

A mounting port 7 for communicating with the inner portion of the main body casing 2 is formed at a generally center position on the front side wall of the main body casing 2, and the front cover 8 for opening and closing the mounting port 7 is also provided. The front cover 8 is pivotably supported around a cover shaft (not shown) inserted through the lower end portion thereof. When the front cover 8 is closed around the cover shaft (not shown) as a fulcrum, the mounting port 7 is closed by the front cover 8. When the front cover 8 is opened around the cover shaft (not shown) as a fulcrum toward the front side, the mounting port 7 is opened.

(2) Sheet Feeding Section

The sheet feeding section 4 includes a sheet feeding tray 10 that is detachably mounted in the bottom portion of the main body casing 2 from the front side thereof. A pickup roller 11 is arranged above the front end portion of the sheet feeding tray 10. Further, the sheet feeding section 4 includes a sheet feeding transport path 17 that is formed generally in a U-shape and provided between above the front end portion of the sheet feeding tray 10 and a transport belt 58 as an example of a belt member described later. A separation pad 13, a pinch roller 14, a sheet dust removing roller 15, and a pair of registration rollers 16 are disposed on the sheet feeding transport path 17.

Sheets 3 stacked on the sheet feeding tray 10 are sent out to the sheet feeding transport path 17 by rotation of the pickup roller 11. The sheets 3 thus sent out are separated one by one between the pickup roller 11 and the separation pad 13. Then, each separated sheet 3 passes between the pinch roller 14 and the sheet dust removing roller 15, so that sheet dust is removed from the sheet 3 by the sheet dust removing roller 15. Thereafter, the sheet 3 is transported to the registration rollers 16. After the registration of the sheet 3, the registration rollers 16 send out the sheet 3 onto the transport belt 58 described later.

(3) Image Forming Section

The image forming section 5 includes a scanning section 20, the processing unit 21, the transferring unit 22, a tensioning mechanism 34 as an example of a lock unit, a cleaning unit 24, and a fixing section 23.

(3-1) Scanning Section

The scanning section 20 is arranged in the upper portion of the main body casing 2. The scanning section 20 includes optical members such as a laser, a mirror and a lens, and emits four laser beams toward the four photosensitive drums 29 described later. Each of the laser beams is irradiated to a surface of each photosensitive drum 29 by high-speed scanning as indicated by a dashed line in FIG. 1.

(3-2) Processing Unit

The processing unit 21 is arranged below the scanning section 20, and above the sheet feeding section 4 and the transferring unit 22 described later. The processing unit 21 includes one drum unit 25, and four developer cartridges 27 corresponding to respective colors of black, yellow, magenta and cyan. The processing unit 21 is detachably mounted in the main body casing 2. Attachment/Detachment of the processing unit 21 will be explained in detail hereinafter. The processing unit 21 is anteroposteriorly attached to or detached from the main body casing 2 on the front side.

(3-2-1) Drum Unit

The drum unit 25 retains four sets of the photosensitive drum 29 of each color, a scorotron charger 30, and a cleaning brush (not shown) in a drum casing 31.

The drum casing 31 is formed in a frame shape, and provided in the front end portion thereof with a process grasp portion 26. By holding process grasp portion 26, the entire processing unit 21 can be moved.

The photosensitive drum 29 has a cylindrical shape in which an outermost surface layer is formed of a positively chargeable photosensitive layer. During an image forming operation, the photosensitive drum 29 is rotated by a driving force from a motor (not shown) provided in the main body casing 2.

The scorotron charger 30 is arranged obliquely rearward above the photosensitive drum 29 so as to be spaced in opposed relation thereto. During an image forming operation, high voltage is applied, so that the surface of the photosensitive drum 29 is charged with a uniform positive polarity.

A cleaning brush (not shown) is arranged behind the photosensitive drum 29 so as to be opposed thereto in contact relation. During an image forming operation, a cleaning bias is applied to the cleaning brush (not shown).

(3-2-2) Developer Cartridge

Each of the developer cartridges 27 corresponding to the photosensitive drum 29 of each color is detachably mounted in the drum unit 25. Each of the developer cartridges 27 includes an agitator 37, a feed roller 38, a developing roller 39 as an example of a developing agent carrier, and a layer-thickness regulating blade 40 in a developer casing 36.

The developer casing 36 is formed in a box-like shape with an opening 41 at a lower end portion thereof. An inner portion of the developer casing 36 is divided into a toner accommodating chamber 43 on the upper side and a developing chamber 44 on the lower side by a partition wall (not shown). The toner accommodating chamber 43 and the developing chamber 44 are in communication with each other by a communication port (not shown) formed in the partition wall (not shown).

The toner accommodating chamber 43 accommodates a toner as an example of a developing agent of a color corresponding to each developer cartridge 27. For the toner of each color, a positively-chargeable, non-magnetic, single-component polymerized toner is used, in which coloring agents of yellow, magenta, cyan or black is mixed corresponding to each color. In the figure, the developer cartridges 27 are distinguished respectively as a yellow developer cartridge 27Y, a magenta developer cartridge 27M, a cyan developer cartridge 27C and a black developer cartridge 27K according to the colors of the accommodated toners.

The agitator 37 is rotatably provided in the toner accommodating chamber 43. During an image forming operation, a driving force from a motor (not shown) provided in the main body casing 2 is transmitted to a rotating shaft of the agitator 37.

The feed roller 38 is provided in the developing chamber 44. The feed roller 38 includes a metal feed roller shaft that is rotatably supported on both the side walls of the developer casing 36 in the width direction, and a sponge roller portion made of an electrically-conductive sponge and covering the feed roller shaft. During an image forming operation, a driving force from a motor (not shown) provided in the main body casing 2 is transmitted to rotate the feed roller 38.

The developing roller 39 is provided obliquely rearward below the feed roller 38 in the developing chamber 44. The developing roller 39 includes a metal developing roller shaft that is rotatably supported on both the side walls of the developer casing 36 in the width direction, and a rubber roller portion made of an electrically-conductive rubber and covering the developing roller shaft. A part of the circumferential surface of the developing roller 39 is exposed downward from the opening 41 of the developing chamber 44. Further, the rubber roller portion of the developing roller 39 is in pressure contact with the sponge roller portion of the feed roller 38. During an image forming operation, a driving force from a motor (not shown) provided in the main body casing 2 is transmitted to rotate the developing roller 39. A developing bias is applied to the developing roller 39.

The layer-thickness regulating blade 40 is provided in the developing chamber 44, and includes a leaf-spring member fixed to the rear side wall of the developer casing 36 and a pressure contact rubber 55 provided at a tip end portion (distal-end portion) of the leaf-spring member. The layer-thickness regulating blade 40 is provided so that the pressure contact rubber 55 is in pressure contact with the developing roller 39 from above.

(3-2-3) Developing Operation in Processing Unit

In each of the developer cartridges 27, a toner of each color accommodated in the corresponding toner accommodating chamber 43 is released to the developing chamber 44 while being agitated by the agitator 37. The toner thus released to the developing chamber 44 is supplied to the feed roller 38. The toner thus supplied to the feed roller 38 is then supplied to the developing roller 39 by rotation of the feed roller 38. At this time, the toner is triboelectrically charged with a positive polarity between the feed roller 38 and the developing roller 39 to which a developing bias is applied. Then, the toner thus supplied to the developing roller 39 enters between the pressure contact rubber 55 of the layer-thickness regulating blade 40 and the developing roller 39 along with the rotation of the developing roller 39. Then, the toner forms a thin layer having a uniform thickness, which is carried on the surface of the developing roller 39.

On the other hand, the surface of the photosensitive drum 29 corresponding to each of the developer cartridges 27 is uniformly positively charged by the scorotron charger 30 along with the rotation of the photosensitive drum 29. Then, the laser beams from the scanning section 20 are irradiated on the surface of the photosensitive drum 29 thus positively charged, thereby forming an electrostatic latent image corresponding to the image to be formed on a sheet 3.

When the electrostatic latent image thus formed on the surface of the photosensitive drum 29 is opposed to the developing roller 39 by the rotation of the photosensitive drum 29, the positively charged toner carried on the surface of the developing roller 39 is supplied to the electrostatic latent image (i.e., of the surface of the photosensitive drum 29 uniformly positively charged, an exposed portion having a lower potential due to the exposure to the laser beams). Thus, the electrostatic latent image is transformed into a visible image, whereby the photosensitive drum 29 carries on its surface a toner image (developing agent image) corresponding to each color by reversal developing.

(3-3) Transferring Unit

In the main body casing 2, the transferring unit 22 is arranged above the sheet feeding section 4 and below the processing unit 21. The transferring unit 22 includes a transfer frame 32, a driving roller 56, a driven roller 57, the transport belt 58, transfer rollers 59, and a backup roller 60. While the driving roller 56 and the driven roller 57 primarily function as examples of a roller member, the transfer rollers 59 and the backup roller 60 are also included in the roller member.

The transferring unit 22 is detachably mounted in the main body casing 2. Attachment/Detachment of the transferring unit 22 will be explained in detail hereinafter. However, the transferring unit 22 is anteroposteriorly attached to or detached from the main body casing 2 on the front side.

The transfer frame 32 is thinner in an up and down direction, and formed in a frame shape of a generally rectangle in plan view. A transfer grasp portion 28 is provided in the front end portion of the transferring unit 22 (see FIG. 2). By holding the transfer grasp portion 28, the entire transferring unit 22 can be moved.

The driving roller 56 and the driven roller 57 extend in the width direction, and further are anteroposteriorly opposed to each other in a spaced relation. Specifically, the driving roller 56 and the driven roller 57 are supported on the rear end portion and the front end portion of the transfer frame 32, respectively. More specifically, the driven roller 57 is previously attached to the transfer frame 32 with anteroposterior play. The driven roller 57 is always urged forward, that is, in a direction away from the driving roller 56, by a spring 33 provided in the transfer frame 32.

The transport belt 58 is an endless belt made of resins, such as polycarbonate or the like, and is wound between the driving roller 56 and the driven roller 57. As described above, the driven roller 57 is urged in the direction away from the driving roller 56 by the spring 33, so that a tension is given to the transport belt 58, thereby preventing the transport belt 58 from becoming detached from the driving roller 56 and the driven roller 57.

The driving roller 56 includes a driving shaft 77 having a shape of a round tube made of aluminum or stainless steel and rotatably supported on the transfer frame 32, and a driving roller portion 78 made of rubber or the like and covering the driving shaft 77. The driving roller portion 78 and the transport belt 58 are frictionally contact with each other, thereby preventing idling of the driving roller 56. Both end portions of the driving shaft 77 in the axial direction (width direction) are exposed outward in the width direction from the transfer frame 32.

The driven roller 57 includes a driven shaft 79 having a shape of a round tube made of aluminum or stainless steel and rotatably supported on the transfer frame 32, and a driven roller portion 80 that covers the driven shaft 79. The outer circumferential surface of the driven roller portion 80 is plated, thereby preventing the outer circumferential surface of the driven roller 57 from being worn away due to the contact with the transport belt 58. Both end portions of the driven shaft 79 in the axial direction (width direction) are exposed outward in the width direction from the transfer frame 32. Both end edges of the driven shaft 79 in the width direction are respectively on the widthwise inner sides of both end edges of the driving shaft 77 in the width direction.

During an image forming operation, a driving force from a motor, which is not shown, provided in the main body casing 2 is transmitted to the driving roller 56 to rotate the driving roller 56. Then, the transport belt 58 is circumferentially moved between the driving roller 56 and the driven roller 57 so as to rotate in a reverse direction to the photosensitive drums 29 at transfer positions where the transport belt 58 is opposed to and in contact with the respective photosensitive drums 29, and the driven roller 57 is driven thereby.

The transfer rollers 59 are supported on the upper portion of the transfer frame 32. The transfer rollers 59 are provided in a ring of transport belt 58 wound between the driving roller 56 and the driven roller 57 so as to be anteroposteriorly spaced from one another and opposed to the respective photosensitive drums 29 with the transport belt 58 sandwiched therebetween. Each of the transfer rollers 59 includes a metal transfer roller shaft rotatably supported on the transfer frame 32, and a rubber roller made of electrically-conductive rubber and covering the transfer roller shaft. Each of the transfer rollers 59 is driven to rotate in the same direction as the circumferentially moving direction of the transport belt 58 at the transfer position where the transfer roller 59 is opposed to and in contact with the transport belt 58. During an image forming operation, a transfer bias is applied to each of the transfer rollers 59.

The backup roller 60 is made of metal and is supported on the lower portion of the transfer frame 32. The backup roller 60 is provided in the ring of the transport belt 58 wound between the driving roller 56 and the driven roller 57 so as to be opposed to a cleaning roller 62 of the cleaning unit 24 described later with the transport belt 58 sandwiched therebetween.

The sheet 3 fed from the sheet feeding section 4 is transported from the front side toward the rear side by the transport belt 58 that is circumferentially moved by the driving of the driving roller 56 and the following movement of the driven roller 57 so that the sheet 3 sequentially passes through the transfer positions of the respective photosensitive drums 29. Then, during the transportation, color toner images carried on the respective photosensitive drums 29 are sequentially transferred and overlapped one another. Thus, a color image is formed on the sheet 3.

(3-4) Tensioning Mechanism

The tensioning mechanism 34 is provided below the transferring unit 22 in the main body casing 2, and more specifically, provided in the vicinity of the driven roller 57.

The tensioning mechanism 34 includes a pair of levers 45 arranged in opposed relation in the width direction, and a pair of coil springs 46 as an example of an urging member corresponding to the respective levers 45. The spacing between the pair of opposed levers 45 is generally equal to the spacing between both the end portions of the driven shaft 79 in the width direction exposed from the transfer frame 32.

The lever 45 is formed in a shape of a thin plate longer in the up and down direction. A swing shaft 47 extending in the width direction is inserted through in a generally center position in the longitudinal direction of the lever 45, and the lever 45 is swingable around the swing shaft 47. A convex 83 expanding forward is formed at the front end edge of a portion above the swing shaft 47(referred to as a lever upper portion 82) in the lever 45.

The coil spring 46 is longer along a generally anteroposterior direction, with the rear end portion thereof fixed to the main body casing 2 side, and the front end portion thereof engaged with a portion below the swing shaft 47 (referred to as a lever lower portion 81) in the lever 45. The coil spring 46 is a tension spring, is contracted in its normal state, and urges the lever lower portion 81 rearward. Thus, the lever upper portion 82 above the swing shaft 47 in the lever 45 is urged forward. A restricting projection 84 is provided behind the lever lower portion 81, and when the lever lower portion 81 urged rearward abuts against the restricting projection 84, unnecessary swinging of the lever 45 due to urging of the coil spring 46 is restricted.

In the transferring unit 22 mounted in the main body casing 2, each of both the end portions of the driven shaft 79 in the width direction exposed from the transfer frame 32 is in engagement with a portion below the convex 83 in the lever upper portion 82 of the corresponding lever 45. Thus, the driven roller 57 having the driven shaft 79 is urged forward, that is, in a direction away from the driving roller 56, by the transmitted urging force of the coil spring 46. Therefore, a tension is given to the transport belt 58. The aforementioned tension given to the transport belt 58 by the spring 33 of the transfer frame 32 has a magnitude by which the transport belt 58 is not detached from the driving roller 56 and the driven roller 57. On the other hand, the tension given to the transport belt 58 when the lever 45 is engaged with the driven shaft 79 has a magnitude required for the aforementioned transfer operation, which is larger than the tension by the spring 33.

(3-5) Cleaning Unit

The cleaning unit 24 is arranged adjacent to the lower side of the transferring unit 22, and includes a toner receiving section 63 and a cleaning roller 62. The toner receiving section 63 is formed in a box-like shape having an opening in an upper portion thereof, and the cleaning roller 62 is supported on both side walls of the toner receiving section 63 in the width direction so that a portion thereof is exposed upward from the opening of the toner receiving section 63. The cleaning roller 62 includes a metal shaft and a foam material made of silicon and covering the shaft. A cleaning bias is applied to the cleaning roller 62. In the transfer operation described above, the toner adhered to the surface of the transport belt 58 is transferred onto the cleaning roller 62 from the surface of the transport belt 58 by a cleaning bias. Thereafter, the toner thus transferred onto the cleaning roller 62 is scraped off by a scraping blade (not shown) provided in the toner receiving section 63, and in turn is stored in the toner receiving section 63.

(3-6) Fixing Section

The fixing section 23 is arranged behind the transferring unit 22, and includes a heating roller 65 and a pressure roller 66 that pressurizes the heating roller 65.

In the fixing section 23, the color image transferred onto the sheet 3 is heated and pressurized while the sheet 3 passes between the heating roller 65 and the pressure roller 66, and is thereby thermally fixed onto the sheet 3.

(4) Sheet Ejecting Section

The sheet ejecting section 6 includes a sheet ejecting path 67 having a generally C-shape opening frontward. An assist roller 68, a transport roller 69, a pinch roller 70 and a pair of sheet ejecting rollers 71 are disposed on the sheet ejecting path 67. The sheet 3 transported from the fixing section 23 is transported along the sheet ejecting path 67 by the assist roller 68, the transport roller 69 and the pinch roller 70, and is then ejected by the sheet ejecting rollers 71 onto a sheet ejection tray 64 formed on an upper surface of the main body casing 2.

2. Attachment/Detachment of Processing Unit and Transferring Unit to/from Main Body Casing Attachment/Detachment of the processing unit 21 and the transferring unit 22 to/from the main body casing 2 will be explained in detail hereinafter.

(1) Attachment/Detachment of Processing Unit to/from Main Body Casing

Figure 2:
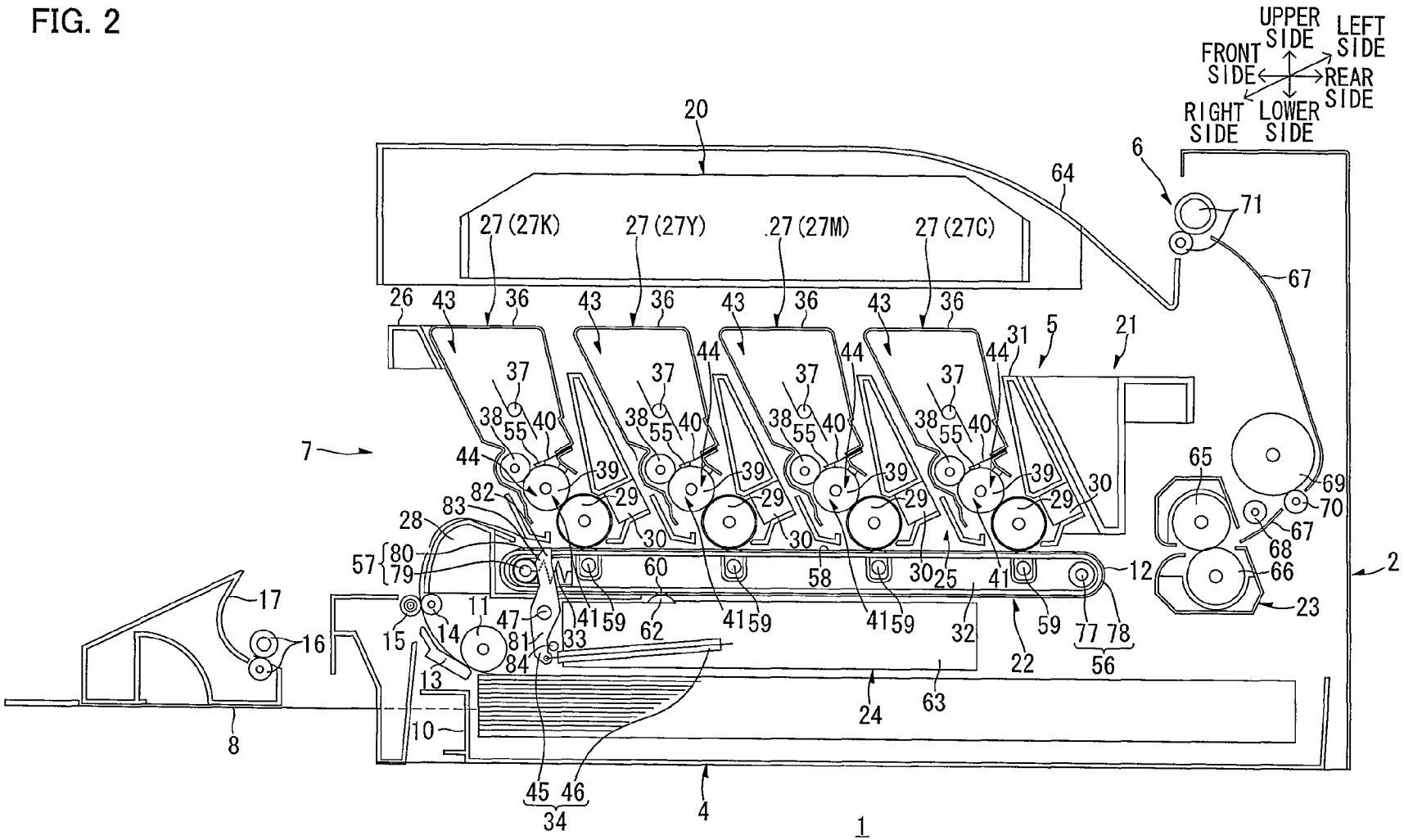
FIG. 2 shows a state where a front cover is opened in FIG. 1.
Figure 3:
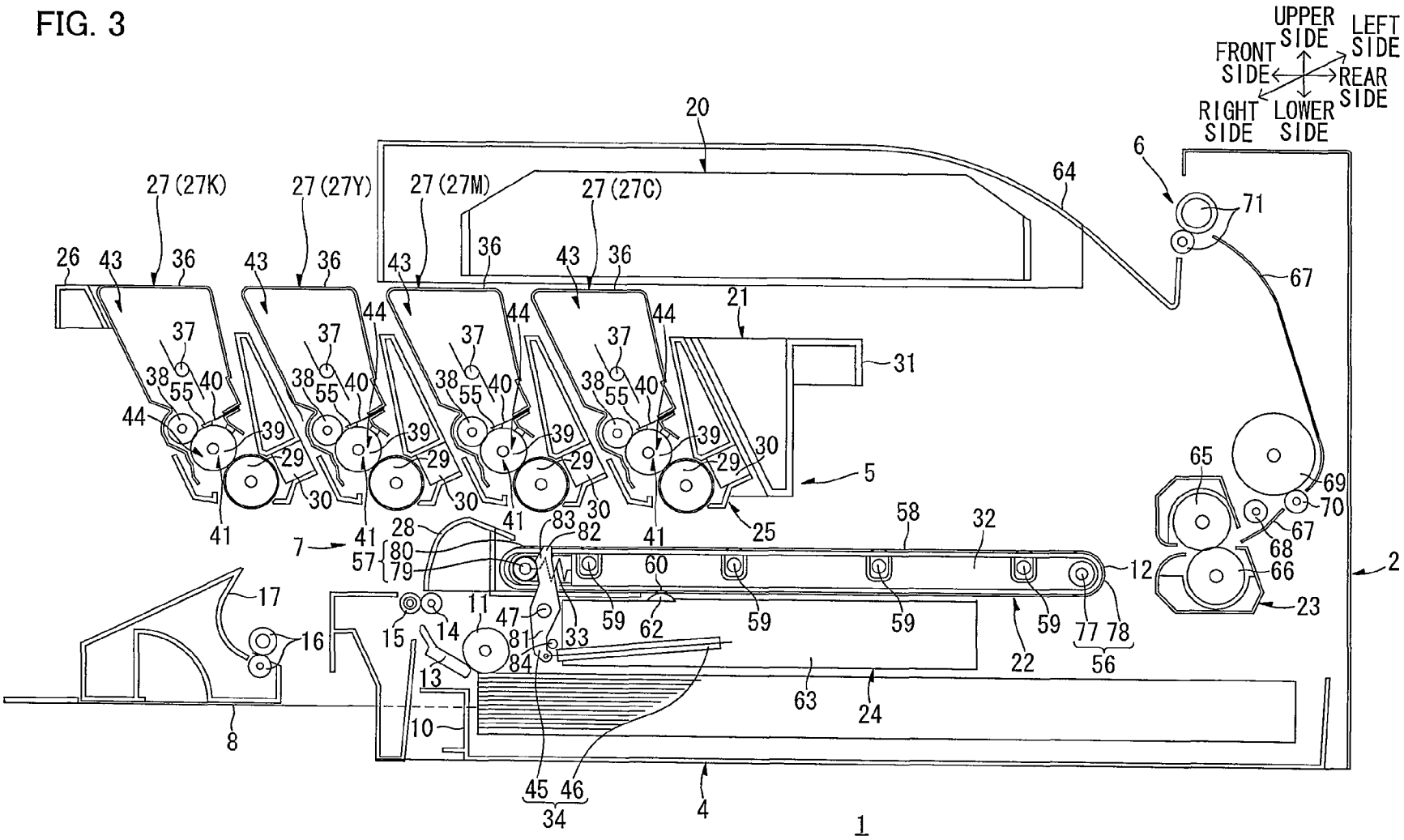
FIG. 3 shows a state where a processing unit is being detached from a main body casing in FIG. 2.

FIG. 2 shows a state where a front cover is opened in FIG. 1. FIG. 3 shows a state where a processing unit is being detached from a main body casing in FIG. 2.

As shown in FIG. 2, first, when the front cover 8 is opened to open the mounting port 7, the front end portion of the processing unit 21, specifically, the process grasp portion 26 is exposed frontward through the mounting port 7. The process grasp portion 26 is then held and pulled to the front, so that the processing unit 21 can be detached from the main body casing 2 as shown in FIG. 3. A processing guide rail (not shown) anteroposteriorly extending is provided in the inner portion of the main body casing 2, and the processing unit 21 slides on the processing guide rail (not shown), and is thus smoothly detached from the main body casing 2 in the anteroposterior direction.

On the other hand, in the case where the processing unit 21 is attached to the main body casing 2, the front cover 8 is opened to open the mounting port 7, and the processing unit 21 is then received on the processing guide rail (not shown) described above. Thereafter, the process grasp portion 26 is held and pushed to the rear, so that the process grasp portion 26 is accommodated in the main body casing 2. Then, the front cover 8 is closed, which completes the attachment of the processing unit 21 to the main body casing 2.

Figure 4:
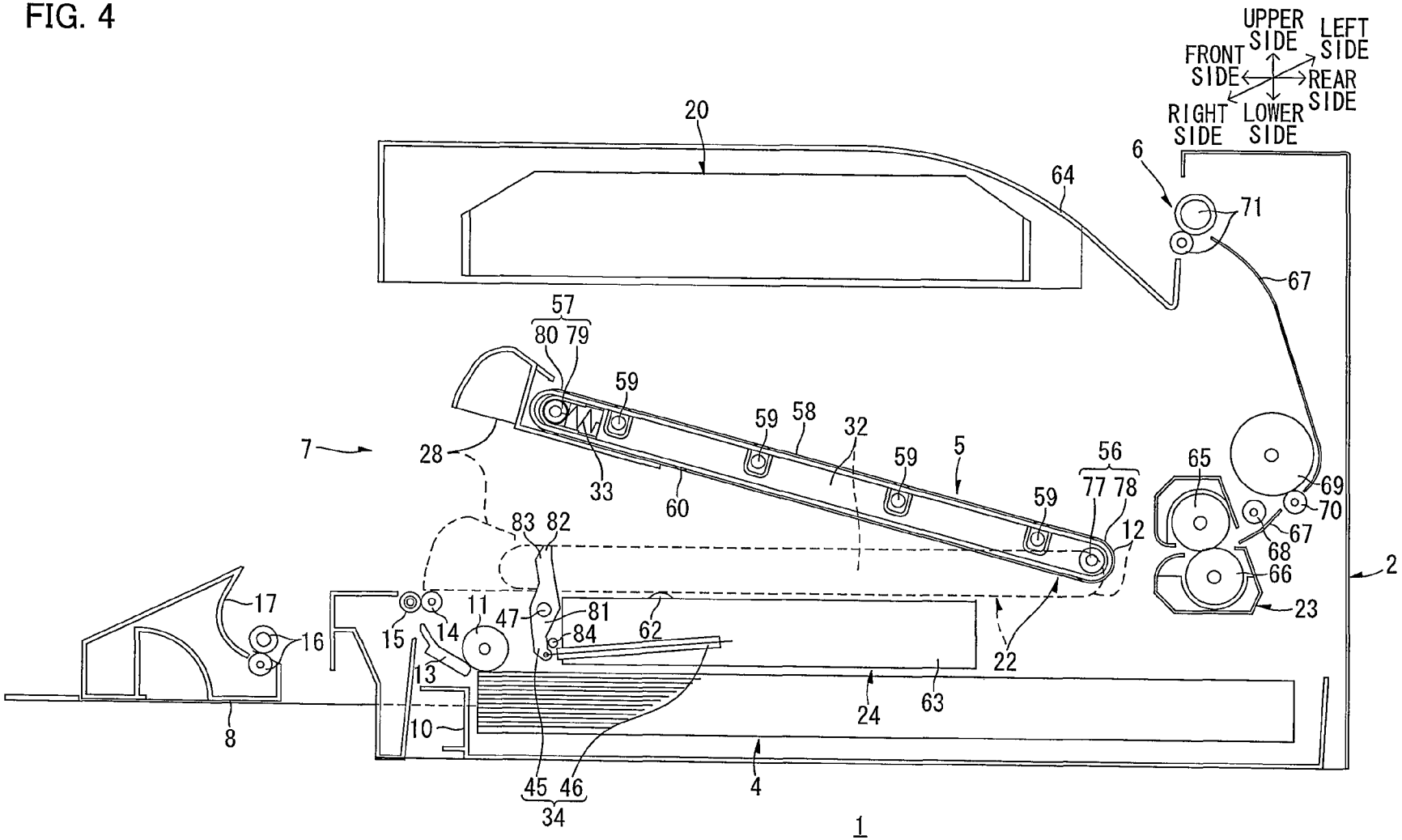
FIG. 4 shows a state where a transferring unit is being detached from the main body casing after the processing unit is already detached in FIG. 3.
Figure 5:
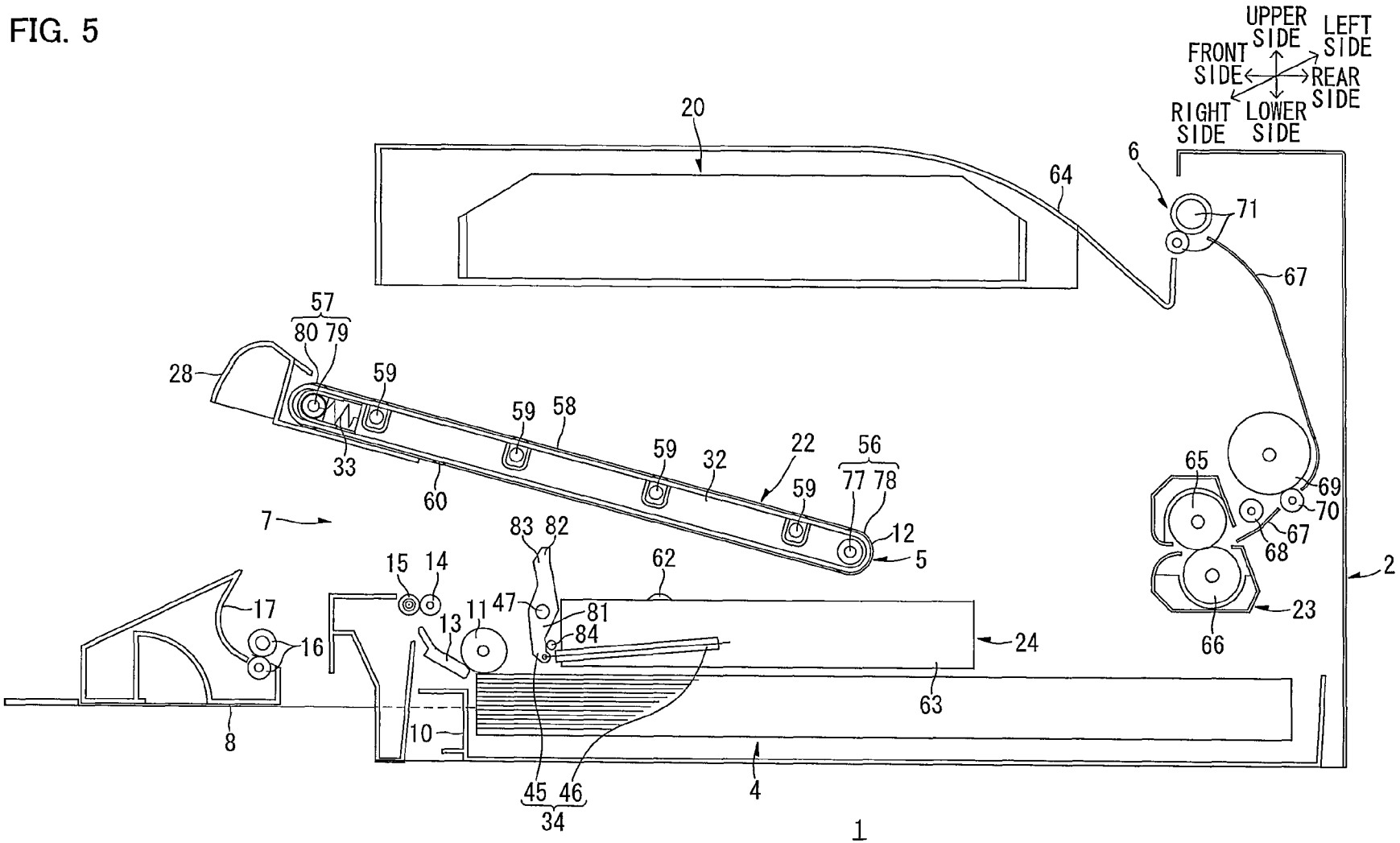
FIG. 5 shows a state where the transferring unit is being further detached from the main body casing in FIG. 4.

(2) Attachment/Detachment of Transferring Unit to/from Main Body Casing (2-1) Detachment of Transferring Unit from Main Body Casing FIG. 4 shows a state where a transferring unit is being detached from the main body casing after the processing unit is already detached in FIG. 3. FIG. 5 shows a state where the transferring unit is being further detached from the main body casing in FIG. 4.

As described above, when the processing unit 21 is detached from the main body casing 2, the upper side surface and the front end portion of the transferring unit 22 (specifically, the transfer grasp portion 28) are exposed through the mounting port 7 (see the indicated dashed line), as shown in FIG. 4. When the transfer grasp portion 28 is held and lifted, the transferring unit 22 is swung about the driving roller 56, and is inclined so that the rear end portion thereof (a rear end portion 12) is more downwardly inclined than before swinging. As the transfer grasp portion 28 is lifted, the driven roller 57 moves upward with respect to the lever 45, so that the driven shaft 79 and the lever 45 are disengaged from each other. Thereafter, when the transfer grasp portion 28 is held and pulled to the front, the transferring unit 22 can be detached from the main body casing 2, as shown in FIG. 5.

(2-2) Attachment of Transferring Unit to Main Body Casing

Figure 6:
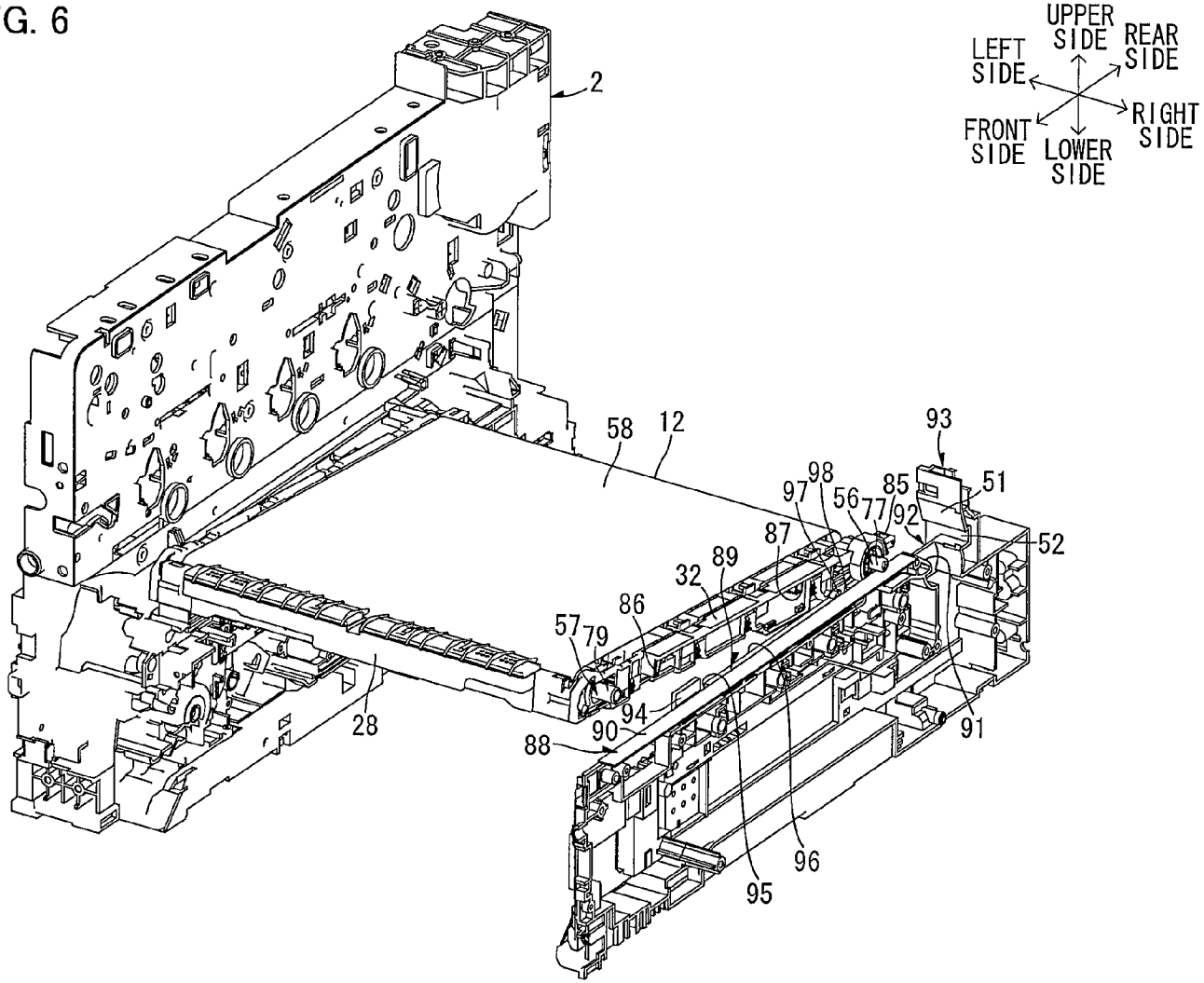
FIG. 6 shows a perspective view of the major portions of the main body casing and the transferring unit in the state of FIG. 4.

FIG. 6 shows a perspective view of the major portions of the main body casing and the transferring unit in the state of FIG. 4.

Figure 7:
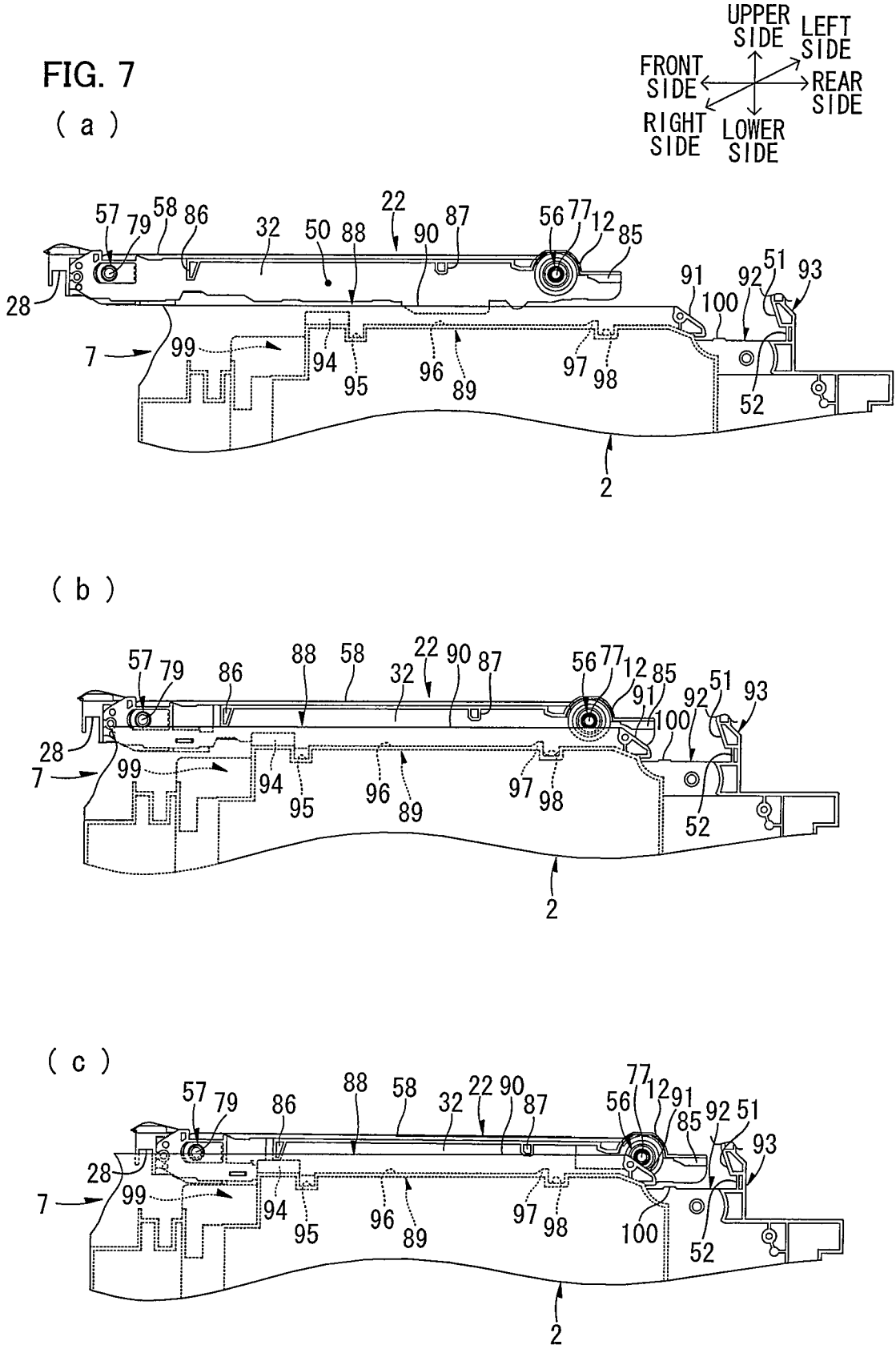
FIG. 7 shows an operational view for explaining a process of mounting the transferring unit to the main body casing, and shows a side sectional view of the major portion of the main body casing in a position where the right side surface of the transferring unit is visible, wherein FIG. 7(*a*) shows a state before a driving shaft is placed on a transfer guide rail and where the transferring unit is in an anteroposteriorly aligned posture, FIG. 7(*b*) shows a state where the driving shaft is placed on a horizontal portion of the transfer guide rail, and FIG. 7(*c*) shows a state where the transferring unit in the state of FIG. 7(*b*) is pushed rearward and the driving shaft is thus placed on an inclined portion of the transfer guide rail.

FIG. 7 shows an operational view for explaining a process of mounting the transferring unit to the main body casing, and shows a side sectional view of the major portion of the main body casing in a position where the right side surface of the transferring unit is visible. In FIG. 7, FIG. 7(*a*) shows a state before a driving shaft is placed on a transfer guide rail and where the transferring unit is in an anteroposteriorly aligned posture, FIG. 7(*b*) shows a state where the driving shaft is placed on a horizontal portion of the transfer guide rail, and FIG. 7(*c*) shows a state where the transferring unit in the state of FIG. 7(*b*) is pushed rearward and the driving shaft is thus placed on an inclined portion of the transfer guide rail.

Figure 8:
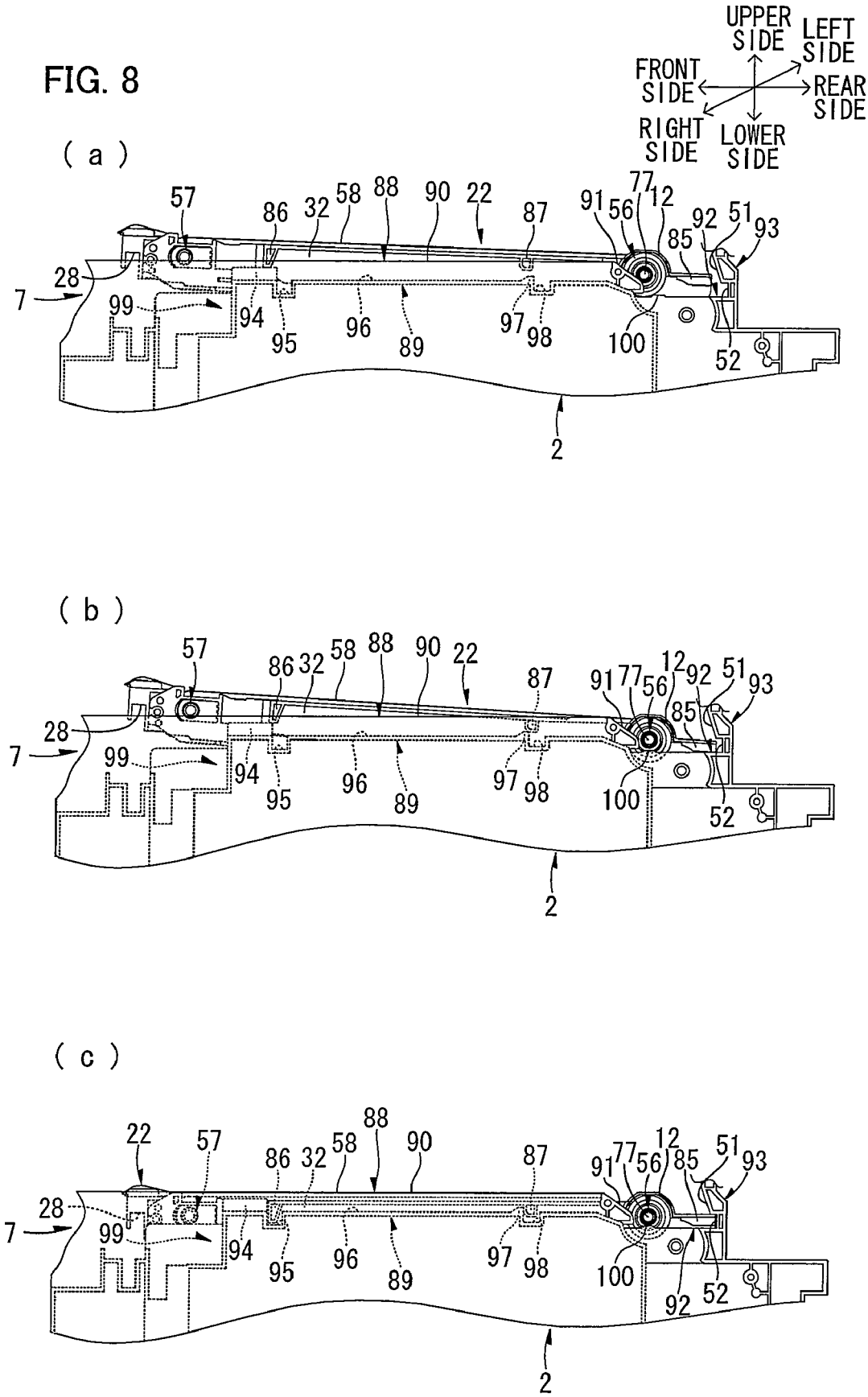
FIG. 8 shows, subsequent to FIG. 7(*c*), an operational view for explaining the process of mounting the transferring unit to the main body casing, wherein FIG. 8(*a*) shows a state where the transferring unit in the state of FIG. 7(*c*) is further pushed rearward, FIG. 8(*b*) shows a state where the transferring unit in the state of FIG. 8(*a*) is pushed rearward and the driving shaft is thus not on the inclined portion of the transfer guide rail, and FIG. 8(*c*) shows a state where the transferring unit in the state of FIG. 8(*b*) is pushed rearward and the transferring unit is thus completely mounted in the main body casing.

FIG. 8 shows, subsequent to FIG. 7(*c*), an operational view for explaining the process of mounting the transferring unit to the main body casing. In FIG. 8, FIG. 8(*a*) shows a state where the transferring unit in the state of FIG. 7(*c*) is further pushed rearward, FIG. 8(*b*) shows a state where the transferring unit in the state of FIG. 8(*a*) is pushed rearward and the driving shaft is thus not on the inclined portion of the transfer guide rail, and FIG. 8(*c*) shows a state where the transferring unit in the state of FIG. 8(*b*) is pushed rearward and the transferring unit is thus completely mounted in the main body casing.

The main body casing 2 and the transferring unit 22 will be explained in more detail to explain attachment of the transferring unit 22 to the main body casing 2.

(2-2-1) Main Body Casing

As shown in FIG. 6, each of the inner side surfaces of both side walls of the main body casing 2 in the width direction is provided with a transfer guide rail 88, a driving shaft support portion 92, a projection receiving portion 93, a driven shaft support portion 99 (see FIG. 7) and a projection guide rail 89, at a generally center position thereof in the up and down direction.

The transfer guide rail 88 is anteroposteriorly formed, and integrally includes a horizontal portion 90 as an example of a second guide portion, and an inclined portion 91.

The horizontal portion 90 is a horizontal plane extended from the front end portion toward the rear end portion of each of the side walls of the main body casing 2 in the width direction.

The inclined portion 91 is an inclined plane continuous from a rear end of the horizontal portion 90 and inclined obliquely rearward and downward.

As shown in FIG. 7(*a*), the driving shaft support portion 92 is arranged slightly below the rear end edge of the inclined portion 91, and the upper end face thereof is a horizontal plane extending rearward. On the upper end face of the driving shaft support portion 92, a step 100 protruded with a step upward is formed in a slightly rearward position with respect to the rear end edge of the inclined portion 91.

The projection receiving portion 93 is arranged continuously from the rear side of the driving shaft support portion 92, and the front end face thereof includes a guide surface 51 and a restricting recess 52 as an example of a restricting portion. The guide surface 51 is inclined obliquely rearward and downward. The restricting recess 52 is recessed rearward so as to connect a lower end edge of the guide surface 51 and a rear end edge of the upper end face of the driving shaft support portion 92. Specifically, the restricting recess 52 is formed in a generally rectangular shape in side view with the front side thereof opened. Further, the restricting recess 52 is arranged lower than a rear projection 85 as an example of a projection described later in the transferring unit 22 midway through mounting to the main body casing 2 (see FIG. 7).

The driven shaft support portion 99, which is not shown, is arranged on the inner side of the transfer guide rail 88 in the width direction, and also anteroposteriorly arranged on the position forward of the step 100 of the driving shaft support portion 92 by a shaft-to-shaft distance between the driving shaft 77 and the driven shaft 79. The upper end face of the driven shaft support portion 99 is a horizontal plane, and is at the same position as the upper end face of the step 100 in the up and down direction.

The projection guide rail 89 is arranged on the inner side of the transfer guide rail 88 in the width direction, arranged anteroposteriorly at generally the same position as the horizontal portion 90, and positioned below the horizontal portion 90 in the up and down direction. The projection guide rail 89 is anteroposteriorly extended, and includes an abutted convex 94 as an example of an abutted portion, a receiving recess 95 as an example of a receiving portion, a projection-side horizontal portion 96, a positioning convex 97, and a positioning recess 98 as an example of a fitting portion, in this order from the front side.

The abutted convex 94 is positioned at the front end of the projection guide rail 89, and is formed so as to be protruded with a step upward on the projection guide rail 89, specifically formed in a generally rectangular shape in side view, with its upper end face horizontal.

The receiving recess 95 is formed in a generally rectangular shape in side view continuous from the rear proximal edge of the abutted convex 94 and recessed downward.

The projection-side horizontal portion 96 is a horizontal plane continuous from the receiving recess 95 and extended rearward.

The positioning convex 97 is formed in a generally triangular shape in side view including an inclined surface that is inclined obliquely rearward and upward from the rear end edge of the projection-side horizontal portion 96, a horizontal surface that extends slightly rearward from the inclined surface, and a vertical surface that extends downward from the horizontal surface. The upper end edge of the positioning convex 97 is positioned lower than the upper end edge of the abutted convex 94.

The positioning recess 98 is formed in a generally rectangular shape in side view continuous from the aforementioned vertical surface of the positioning convex 97 and recessed downward.

(2-2-2) Transferring Unit

As shown in FIG. 6, in the transferring unit 22, each of the end portions of the transfer frame 32 in the width direction is provided with the rear projection 85, a first abutting projection 86 as an example of an abutting portion, and a second abutting projection 87 as an example of a protruded portion.

The rear projection 85 is projected rearward so as to be in parallel (anteroposteriorly in FIG. 7(*a*)) to the transfer frame 32 at a position rearward of each of the end portions of the driving roller 56 in the width direction. Specifically, the rear projection 85 is formed in a generally rectangular shape in side view, and with reference to FIG. 7(*a*), the upper end face thereof is at generally the same position in the up and down direction as the shaft center of the driving roller 56. An anteroposterior distance from the shaft center of the driving roller 56 to the rear end edge of the rear projection 85 is generally equal to that from the step 100 to the deepest portion (rear end portion) of the restricting recess 52. More specifically, the side surface of the rear end portion of the rear projection 85 is shaped generally identical to the side surface of the restricting recess 52.

The first abutting projection 86 is formed so as to protrude downward at a position slightly rearward of the driven roller 57 but at a position forward of a gravity center 50 (see FIG. 7(*a*)) of the transferring unit 22, specifically, formed in a generally triangular shape tapering downward in side view. More specifically, the side surface of a generally lower half portion of the first abutting projection 86 is shaped smaller than the side surface of the receiving recess 95. In the width direction, the outer end edge of the first abutting projection 86 is on the inner side of the outer end edge of the driven shaft 79 (see FIG. 6).

The second abutting projection 87 is formed so as to protrude downward at a position rearward of the first abutting projection 86 by an anteroposterior spacing between the receiving recess 95 and the positioning recess 98, specifically, formed in a generally rectangular shape in side view. With reference to FIG. 7(*a*), the amount of downward protrusion of the second abutting projection 87 is approximately half of that of the first abutting projection 86. In the width direction, the outer end edge of the second abutting projection 87 is on the inner side of the outer end edge of the driven shaft 79 (see FIG. 6).

(2-2-3) Attachment of Transferring Unit to Main Body Casing

As shown in FIG. 7(*a*), the transfer grasp portion 28 is held, and the transferring unit 22 is then accommodated in the main body casing 2. At this time, in front view, both end portions of the driving shaft 77 in the width direction are opposed to the corresponding transfer guide rails 88 from above, both end portions of the driven shaft 79 in the width direction are opposed to the corresponding driven shaft support portions 99 from above, and the first abutting projection 86 and the second abutting projection 87 are opposed to the corresponding projection guide rails 89 from above.

As shown in FIG. 7(*b*), both the end portions of the driving shaft 77 in the width direction are placed on the horizontal portions 90 of the corresponding transfer guide rails 88(portions other than the driving shaft 77 in the transferring unit 22 are not in contact with the main body casing 2), and the transfer grasp portion 28 is held and the transferring unit 22 is then pushed rearward. At this time, the driving shaft 77 slides on the horizontal portion 90, whereby the transferring unit 22 is smoothly guided rearward.

The transferring unit 22 is subsequently pushed rearward, and immediately before the driving shaft 77 moves from the horizontal portion 90 to the inclined portion 91 on the transfer guide rail 88, the first abutting projection 86 abuts against the abutted convex 94 of the projection guide rail 89 from above. At this time, the transferring unit 22 is in a generally horizontally aligned posture. The second abutting projection 87 is positioned above the projection-side horizontal portion 96 in spaced relation. As described above, since the first abutting projection 86 is formed at the position forward of the gravity center 50 (see FIG. 7(*a*)) of the transferring unit 22, the first abutting projection 86 abuts against the abutted convex 94 at the position forward of the gravity center 50 (see FIG. 7(*a*)) of the transferring unit 22.

Thereafter, as shown in FIG. 7(*c*), when the transferring unit 22 is subsequently pushed rearward and the driving shaft 77 is then moved from the horizontal portion 90 to the inclined portion 91, the driving shaft 77 descends according to the inclination of the inclined portion 91. On the other hand, the first abutting projection 86 subsequently abuts against the abutted convex 94, so that the transferring unit 22 is inclined with its rear end portion 12 facing downward. At this time, the rear end portion of the rear projection 85 is anteroposteriorly opposed in spaced relation to the guide surface 51 of the corresponding projection receiving portion 93.

As shown in FIG. 8(*a*), when the transferring unit 22 is further pushed rearward, the driving shaft 77 further descends according to the inclination of the inclined portion 91. On the other hand, since the first abutting projection 86 keeps abutting against the abutted convex 94, the transferring unit 22 is further inclined.

As shown in FIG. 8(*b*), the transferring unit 22 is further pushed rearward, and the driving shaft 77 is then detached from the inclined portion 91. Even immediately thereafter, the first abutting projection 86 keeps abutting against the abutted convex 94, so that the transferring unit 22 maintains the inclined state. Here, in the process from FIG. 8(*a*) to FIG. 8(*b*), the second abutting projection 87 passes by the positioning convex 97 with almost no contact, and the rear end portion of the rear projection 85 is generally opposed to the restricting recess 52 in the anteroposterior direction without contacting the guide surface 51.

The transferring unit 22 is further pushed rearward, and as shown in FIG. 8(*c*), the driving shaft 77 is then placed on the step 100 of the driving shaft support portion 92, whereby the transferring unit 22 is completely attached in the main body casing 2. At this time, the first abutting projection 86 is detached from the abutted convex 94, and the generally lower half portion thereof is received in the receiving recess 95, while the second abutting projection 87 is fitted in the positioning recess 98, and the rear projection 85 comes into engagement with the restricting recess 52. Thus, the transferring unit 22 inclined until then becomes in a generally horizontally aligned posture. Here, it can be seen that in the state where the transferring unit 22 midway through the mounting is inclined (see FIGS. 7(*c*), 8(*a*), and 8(*b*)), the rear end portion 12 is more downwardly inclined than the rear end portion 12 at the completion of the mounting (see FIG. 8(*c*)).

Since the side surface of the generally lower half portion of the first abutting projection 86 is shaped smaller than the side surface of the receiving recess 95 as described above, the first abutting projection 86 is received in the receiving recess 95 in a loosely fitted state. Further, since the side surface of the rear end portion of the rear projection 85 is shaped generally identical to the side surface of the restricting recess 52 as described above, the rear projection 85 engages with the restricting recess 52 with almost no gap, and the upward movement thereof is restricted. Therefore, the transferring unit 22 is positioned relative to the main body casing 2 in the up and down direction.

At the completion of the mounting of the transferring unit 22, the driven shaft 79 is placed on the upper end face of the driven shaft support portion 99. At this time, since the driven shaft 79 comes into engagement with the aforementioned lever 45 (see FIG. 1), the driven roller 57 is urged forward by the lever 45 as described above. Here, the forward urging force also acts on the second abutting projection 87 fitting in the positioning recess 98, whereby the second abutting projection 87 is pushed against the aforementioned vertical surface of the positioning convex 97 that is continuous from the front side of the positioning recess 98. Thus, the transferring unit 22 is anteroposteriorly positioned relative to the main body casing 2, and is fixed to the main body casing 2. In the state where the transferring unit 22 is anteroposteriorly positioned relative to the main body casing 2, the driven roller 57 is kept being urged forward by the lever 45, so that the aforementioned tension is given to the transport belt 58.

In the detachment of the processing unit 21 from the main body casing 2 as described above, when the transfer grasp portion 28 is held, lifted and then pulled to the front, the first abutting projection 86 is detached from the receiving recess 95, the second abutting projection 87 is released from the fitting state with the positioning recess 98, and the rear projection 85 is detached from the restricting recess 52. Thus, the transferring unit 22 is inclined in the same manner as that during mounting. When the transfer grasp portion 28 is held and further pulled to the front, the driving shaft 77 slides on the inclined portion 91 and the horizontal portion 90 in this order, whereby the transferring unit 22 is guided forward. Thus, the transferring unit 22 can be smoothly detached from the main body casing 2.

3. Operations and Effects

In this color laser printer 1, as shown in FIGS. 7 and 8, the transferring unit 22 is anteroposteriorly attached and detached to and from the main body casing 2 on the front side, so that the transferring unit 22 can be attached and detached by front access. As shown in FIG. 8(*c*), at the completion of the mounting of the transferring unit 22, the rear projection 85 provided at the rear end portion 12 of the transferring unit 22 comes into engagement with the restricting recess 52 provided in the main body casing 2, thereby restricting the upward movement of the rear projection 85. This can prevent the rear end portion 12 of the transferring unit 22 from lifting up at the completion of the mounting of the transferring unit 22, thereby allowing positioning of the transferring unit 22 in the up and down direction.

Here, as shown in FIG. 7, the restricting recess 52 is arranged lower than the rear projection 85 of the transferring unit 22 midway through the mounting. Therefore, when the transferring unit 22 is simply anteroposteriorly mounted, there is a possibility that the rear projection 85 may be caught by the guide surface 51 above the restricting recess 52 in the main body casing 2 and may not engage with the restricting recess 52. In this case, smooth mounting and positioning of the transferring unit 22 cannot be achieved.

However, the transferring unit 22 is provided with the first abutting projection 86, and the main body casing 2 is provided with the abutted convex 94. As shown in FIGS. 7(*c*), 8(*a*) and 8(*b*), the transferring unit 22 can be guided in the following manner. Simply by abutting the first abutting projection 86 against the abutted convex 94, the transferring unit 22 is easily inclined so that the rear end portion 12 of the transferring unit 22 midway through the mounting is more downwardly inclined than the rear end portion 12 at the completion of the mounting (see FIG. 8(*c*)) without any special support by a user, thereby engaging the rear projection 85 with the restricting recess 52. Here, the first abutting projection 86 and the abutted convex 94 function as examples of a first guide portion.

Thus, the problem that the rear projection 85 is not engaged with the restricting recess 52 due to the aforementioned caught can be solved.

As a result, the mounting and positioning of the transferring unit 22 by front access can be smoothly performed.

Further, the first abutting projection 86 is provided so as to protrude downward from the transferring unit 22. With such simple structure, when the first abutting projection 86 abuts against the abutted convex 94, the transferring unit 22 can be reliably inclined.

As described above, if the transferring unit 22 can be inclined so that the rear end portion 12 of the transferring unit 22 midway through the mounting is more downwardly inclined than the rear end portion 12 at the completion of the mounting, the first abutting projection 86 and the abutted convex 94 may be provided in the main body casing 2 and the transferring unit 22, respectively. Further, instead of the first abutting projection 86 and the abutted convex 94, either of the transfer guide rail 88 and the projection guide rail 89 itself may be inclined so as to make the transferring unit 22 inclined.

Since the first abutting projection 86 abuts against the abutted convex 94 on the position forward of the gravity center 50 (see FIG. 7(*a*)) of the transferring unit 22, the transferring unit 22 can be inclined in a stable state, as compared with the case of abutting against the abutted convex 94 on the position rearward of the gravity center 50 thereof, and so that the rear end portion 12 of the transferring unit 22 midway through the mounting is more downwardly inclined than the rear end portion 12 at the completion of the mounting.

The receiving recess 95 arranged on the position rearward of the abutted convex 94 and receiving the first abutting projection 86 in a loosely fitted state at the completion of the mounting of the transferring unit 22 is provided in the main body casing 2. Therefore, as shown in FIG. 8(*c*), in the state where the transferring unit 22 is completely mounted and the rear projection 85 is in engagement with the restricting recess 52, the first abutting projection 86 is released from the abutment against the abutted convex 94 and received in the receiving recess 95. Thus, the transferring unit 22 is not continuously inclined and can be arranged in the main body casing 2 in a generally anteroposteriorly aligned posture. Further, the first abutting projection 86 is received in the receiving recess 95 in a loosely fitted state, so that inaccurate positioning of the transferring unit 22 due to the receiving of the first abutting projection 86 by the receiving recess 95 can be prevented.

The transferring unit 22 is provided with the second abutting projection 87 arranged on the position rearward of the first abutting projection 86 and protruding downward, and the main body casing 2 is provided with the positioning recess 98 arranged on the position rearward of the receiving recess 95 and fitted with the second abutting projection 87 at the completion of the mounting of the transferring unit 22. Therefore, at the completion of the mounting of the transferring unit 22, the second abutting projection 87 protruding downward fits in the positioning recess 98, so that the anteroposterior movement of the second abutting projection 87 is restricted, thereby allowing the transferring unit 22 to be anteroposteriorly positioned.

In the transferring unit 22, the first abutting projection 86 is provided separately from the driving roller 56, the driven roller 57, the transfer rollers 59, and the backup roller 60. Therefore, these rollers do not abut against the abutted convex 94, which can prevent these rollers from being damaged.

The main body casing 2 includes the horizontal portion 90 anteroposteriorly formed in order to guide the mounting of the transferring unit 22, and the horizontal portion 90 is formed above the abutted convex 94. Therefore, the first abutting projection 86 provided in the transferring unit 22 so as to protrude downward therefrom can be reliably abutted against the abutted convex 94 on the way of guiding the mounting of the transferring unit 22 by the horizontal portion 90.

Further, the horizontal portion 90 guides the driving shaft 77 of the driving roller 56 that is disposed on the rearmost side of the driving roller 56, the driven roller 57, the transfer rollers 59 and the backup roller 60 in the transferring unit 22. That is, the horizontal portion 90 guides the driving shaft 77 of the driving roller 56 that is at a position farthest from a user who performs attachment/detachment operation of the transferring unit 22 on the front side of the color laser printer 1 by front access. Therefore, as compared with the case where the horizontal portion 90 guides the rollers other than the driving roller 56, the transferring unit 22 can be attached to or detached from the main body casing 2 in a stable state without misalignment.

As shown in FIG. 1, the color laser printer 1 of a so-called tandem type can be provided by providing the plurality of photosensitive drums 29 corresponding to the respective developing rollers 39. As shown in FIG. 3, the processing unit 21 retaining these photosensitive drums 29 is attached to or detached from the main body casing 2 on the front side in the same manner as the transferring unit 22, so that the color laser printer 1 further achieving front access can be provided.

As described above, the transferring unit 22 is fixed to the main body casing 2 by engaging the driven shaft 79 of the driven roller 57 with the lever 45 of the tensioning mechanism 34, so that inaccurate positioning of the transferring unit 22 can be prevented.

As described above, the driven shaft 79 of the driven roller 57, which is disposed on the frontmost side of the aforementioned rollers provided in the transferring unit 22 and is engaged with the lever 45, is urged forward by the coil spring 46 provided in the tensioning mechanism 34. This can give a tension to the transport belt 58 wound around the driving roller 56, the driven roller 57, the transfer rollers 59 and the backup roller 60, so that unnecessary slack in the transport belt 58 can be suppressed. As a result, in the transferring unit 22, a preferred transfer operation can be achieved.

Second Embodiment

Figure 9:
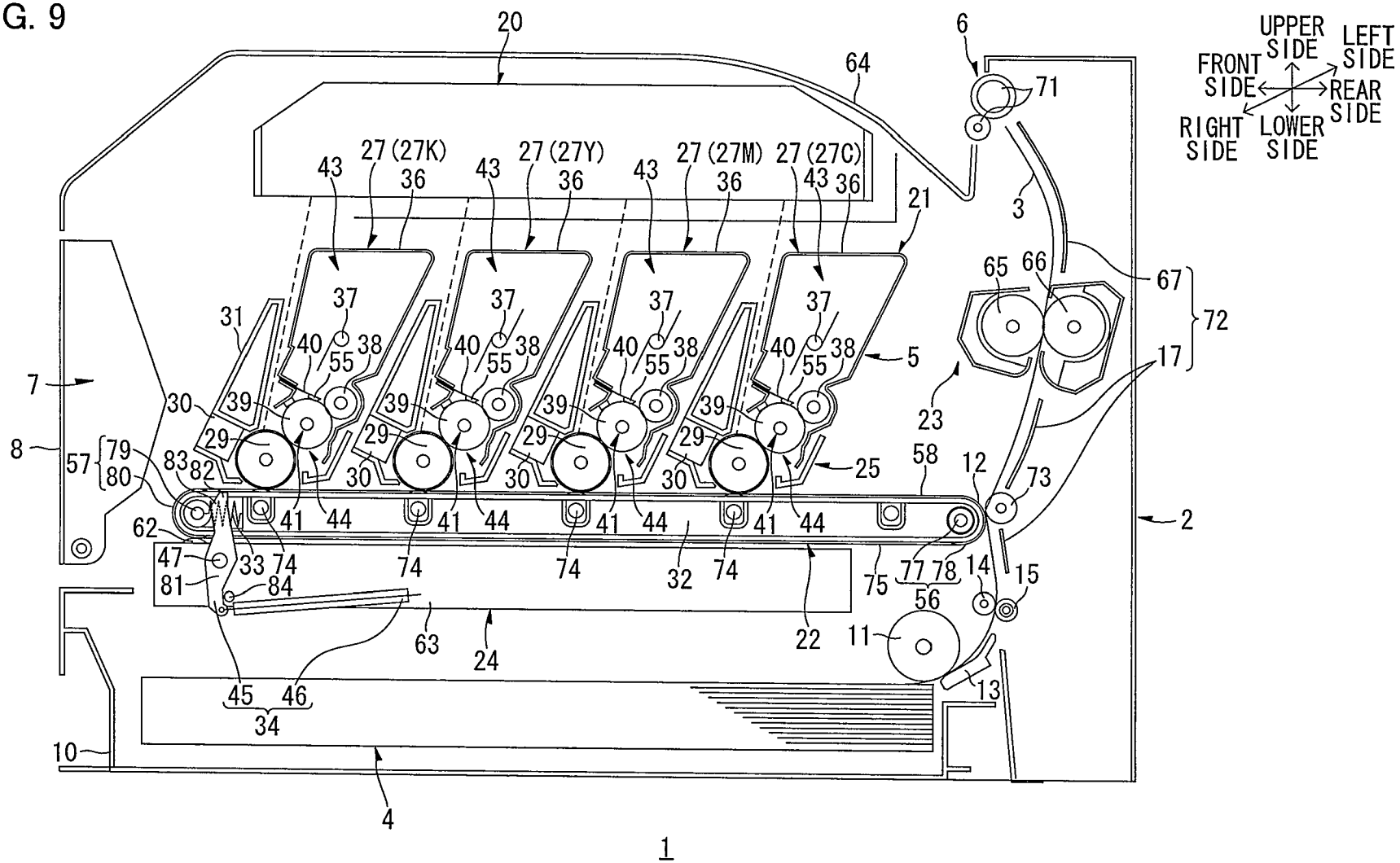
FIG. 9 is a side sectional view of a color laser printer as a variation according to one or more aspects of the present invention.

FIG. 9 is a side sectional view of a color laser printer as a variation according to one or more aspects of the present invention.

In the embodiment described above, the color laser printer 1 of a tandem type for directly transferring toner images onto a sheet 3 from each photosensitive drum 29 is illustrated. However, one or more aspects of the present invention is not limited thereto. As shown in FIG. 9, the color laser printer 1 according to one or more aspects of the present invention can also be constituted, for example, as a color laser printer of an intermediate transfer type in which toner images for respective colors are once transferred to an intermediate transfer body (an intermediate transfer belt 75 described later) from the respective photosensitive drums 29, and thereafter, transferred onto a sheet 3 by one operation.

In the color laser printer 1 of the intermediate transfer type, for example, the sheet feeding transport path 17 and the sheet ejecting transport path 67 both described above are integrally formed (collectively referred to as a transport path 72), and the transport path 72 connects between the pickup roller 11 and the sheet ejecting rollers 71. On the transport path 72, the separation pad 13, the pinch roller 14, the sheet dust removing roller 15, a secondary transfer roller 73, and the fixing section 23 are disposed.

Here, the transfer roller 59 described above is referred to as a primary transfer roller 74 corresponding to the secondary transfer roller 73, and the transport belt 58 described above is referred to as the intermediate transfer belt 75.

The secondary transfer roller 73 is arranged in opposed relation to the driving roller 56 on the position rearward of the driving roller 56 so as to sandwich the intermediate transfer belt 75 between the secondary transfer roller 73 and the driving roller 56. The secondary transfer roller 73 is supported on the main body casing 2, and a secondary transfer bias is applied thereto during secondary transfer.

The sheet 3 sent out to the transport path 72 is transported to a secondary transfer position between the secondary transfer roller 73 and the intermediate transfer belt 75.

The intermediate transfer belt 75 that is circumferentially moved by the driving of the driving roller 56 and the following movement of the driven roller 57 sequentially passes from the front to the rear through positions in contact with the respective photosensitive drums 29 (primary transfer positions). During the passage, color toner images carried on the respective photosensitive drums 29 are sequentially transferred to the intermediate transfer belt 75 by a transfer bias (primary transfer bias) applied to each of the primary transfer rollers 74, whereby a color toner image is formed on the intermediate transfer belt 75.

While the intermediate transfer belt 75 passes through a position in contact with the secondary transfer roller 73 (secondary transfer position), the color toner image formed on the intermediate transfer belt 75 is collectively transferred to the sheet 3 transported to the secondary transfer position, by the secondary transfer bias. After the sheet 3 having the color toner image transferred thereon is transported to the fixing section 23 along the transport path 72, the color toner image is fixed and the sheet 3 is ejected in the same manner as the color laser printer 1 of a tandem type.

Also, in the color laser printer 1 of this intermediate transfer type, the mounting and positioning of the transferring unit 22 by front access can be smoothly performed by applying one or more aspects of the present invention.

Third Embodiment

In the aforementioned embodiment, the transferring unit 22 is mounted to the main body casing 2 in a state where the cleaning unit 24 remains accommodated in the main body casing 2. However, the transferring unit 22 and the cleaning unit 24 may be integrally attached to or detached from the main body casing 2 by integrating the transferring unit 22 and the cleaning unit 24.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus comprising:

a casing;

a plurality of developing agent carriers provided in the casing and carrying developing agents of mutually different colors;

an image carrier provided in the casing, supplied with a developing agent from each of the developing agent carriers, and carrying a developing agent image thereon; and a transferring unit anteroposteriorly detachably mountable to the casing on a front side of the casing, for transferring the developing agent image carried on the image carrier to a transfer medium, wherein the transferring unit comprises a projection at a rear end portion thereof, the casing comprises a restricting portion that is arranged lower than the projection of the transferring unit in a mounting state of the transferring unit and is engaged with the projection in a mounted state of the transferring unit to restrict an upward movement of the projection, and the casing comprises a first guide portion for slidably guiding the transferring unit by inclining the transferring unit from the front side to a rear side of the transferring unit so that the rear end portion of the transferring unit in the mounting state is more downwardly inclined than the rear end portion in the mounted state of the transferring unit, to engage the projection with the restricting portion.

2. The image forming apparatus according to claim 1, wherein the transferring unit includes an abutting portion, and the first guide portion includes an abutted portion abutted by the abutting portion, wherein the transferring unit is inclined by abutment of the abutting portion against the abutted portion in the mounting state.

3. The image forming apparatus according to claim 2, wherein the abutting portion abuts against the abutted portion on a position forward of a gravity center of the transferring unit.

4. The image forming apparatus according to claim 2, wherein the abutting portion protrudes downward.

5. The image forming apparatus according to claim 4, wherein the casing comprises a receiving portion arranged on a position rearward of the abutted portion and receiving the abutting portion in a loosely fitted state in the mounted state.

6. The image forming apparatus according to claim 5, wherein the transferring unit is provided with a protruded portion arranged on a position rearward of the abutting portion and protruding downward, and the casing comprises a fitting portion arranged on a position rearward of the receiving portion and allowing the protruded portion to fit therein in the mounted state.

7. The image forming apparatus according to claim 4, wherein the transferring unit comprises a roller member including a shaft and a roller portion that covers the shaft, and the abutting portion is provided separately from the roller member.

8. The image forming apparatus according to claim 4, wherein the casing comprises a second guide portion anteroposteriorly formed to guide attachment and detachment of the transferring unit, and the second guide portion is formed above the abutted portion.

9. The image forming apparatus according to claim 8, wherein the transferring unit comprises at least two roller members each including a shaft and a roller portion that covers the shaft, and a belt member wound between the roller members, and the second guide portion guides a shaft of a roller member disposed on the rearmost side of the roller members.

10. The image forming apparatus according to claim 1, further comprising:

a plurality of the image carriers provided corresponding to the respective developing agent carriers; and a retaining unit that retains the plurality of image carriers and is detachably mounted to the casing, wherein the retaining unit is arranged above the transferring unit and is attached to and detached from the casing on the front side of the casing.

11. The image forming apparatus according to claim 1, wherein the casing comprises a lock unit for fixing the transferring unit, the transferring unit comprises at least two roller members each including a shaft and a roller portion that covers the shaft, and a belt member wound between the roller members, and the lock unit comprises an urging member that urges forward a shaft of a roller member disposed on the frontmost side of the roller members.

12. An image forming apparatus comprising:

a casing;

a plurality of developing agent carriers provided in the casing and carrying developing agents of mutually different colors;

an image carrier provided in the casing, supplied with a developing agent from each of the developing agent carriers, and carrying a developing agent image thereon; and a transferring unit anteroposteriorly detachably mountable to the casing on a front side of the casing, for transferring the developing agent image carried on the image carrier to a transfer medium, wherein the transferring unit comprises a projection at a rear end portion thereof, the casing comprises a restricting portion that is arranged lower than the projection of the transferring unit in a mounting state of the transferring unit and is engaged with the projection in a mounted state of the transferring unit to restrict an upward movement of the projection, and the transferring unit comprises a first abutting portion, which is slidably guided from the front side to a rear side of the transferring unit along a surface of the casing during mounting so that the rear end portion of the transferring unit in the mounting state is more downwardly inclined than the rear end portion in the mounted state of the transferring unit, to engage the projection with the restricting portion.

13. The image forming apparatus according to claim 12, wherein the casing includes an abutted portion abutted by the abutting portion, wherein the transferring unit is inclined by abutment of the abutting portion against the abutted portion in the mounting state.

14. The image forming apparatus according to claim 13, wherein the abutting portion abuts against the abutted portion on a position forward of a gravity center of the transferring unit.

15. The image forming apparatus according to claim 13, wherein the abutting portion protrudes downward, and wherein the casing comprises a receiving portion arranged on a position rearward of the abutted portion and receiving the abutting portion in a loosely fitted state in the mounted state.

16. The image forming apparatus according to claim 15, wherein the transferring unit is provided with a protruded portion arranged on a position rearward of the abutting portion and protruding downward, and the casing comprises a fitting portion arranged on a position rearward of the receiving portion and allowing the protruded portion to fit therein in the mounted state.

17. The image forming apparatus according to claim 13, wherein the abutting portion protrudes downward, the transferring unit comprises a roller member including a shaft and a roller portion that covers the shaft, and the abutting portion is provided separately from the roller member.

18. The image forming apparatus according to claim 13, wherein the abutting portion protrudes downward, the casing comprises a second guide portion anteroposteriorly formed to guide attachment and detachment of the transferring unit, and the second guide portion is formed above the abutted portion.

19. The image forming apparatus according to claim 18, wherein the transferring unit comprises at least two roller members each including a shaft and a roller portion that covers the shaft, and a belt member wound between the roller members, and the second guide portion guides a shaft of a roller member disposed on the rearmost side of the roller members.

20. The image forming apparatus according to claim 12, wherein the casing comprises a lock unit for fixing the transferring unit, the transferring unit comprises at least two roller members each including a shaft and a roller portion that covers the shaft, and a belt member wound between the roller members, and the lock unit comprises an urging member that urges forward a shaft of a roller member disposed on the frontmost side of the roller members.

* * * * *